US005109773A

United States Patent [19]

Kaneko

[11] Patent Number: 5,109,773

[45] Date of Patent: May 5, 1992

[54] PUSH-TYPE CRACKER

[75] Inventor: Nobusato Kaneko, Ehime, Japan

[73] Assignees: Fujika Co., Ltd., Ehime; Kaneko Fire Works Co. Ltd., Saitama, both of Japan

[21] Appl. No.: 607,315

[22] Filed: Oct. 31, 1990

[30] Foreign Application Priority Data

Dec. 26, 1989 [JP] Japan ..... 1-337526

[51] Int. Cl.[5] ..... F42B 4/04

[52] U.S. Cl. ..... 102/357; 102/361

[58] Field of Search ..... 102/305, 355, 357, 361

[56] References Cited

U.S. PATENT DOCUMENTS

| | | | |
|---|---|---|---|
| 1,663,679 | 3/1928 | Carpenter | 102/302 |
| 3,610,152 | 10/1971 | Kaneko et al. | 102/357 |
| 3,744,417 | 7/1973 | Kaneko | 102/355 |
| 4,495,868 | 1/1985 | Matthews | 102/357 |

*Primary Examiner*—Peter A. Nelson

*Attorney, Agent, or Firm*—Koda and Androlia

[57] ABSTRACT

A push-type cracker wherein frictional ignition is effected between a trigger string and a powder explosive by depressing the trigger string from a direction perpendicular to the longitudinal direction of the string, the powder explosive being thereby accurately exploded.

4 Claims, 6 Drawing Sheets

PUSH-TYPE CRACKER

BACKGROUND OF THE INVENTION

1. Field of the Invention

This invention relates to a push-type cracker adapted to be fired by finger push.

2. Description of the Prior Art

Hitherto, there has been known a push-type cracker designed so that an explosive is exploded by finger-pushing a finger-push portion of an outer shell while the body of the cracker is held in one hand, as shown in FIGS. 8 to 10 in Japanese Utility Model Publication No. 45-17199.

SUMMARY OF THE INVENTION

The known push-type cracker includes a rod fitted in an explosive cylinder, and an explosive to be exploded by sliding friction of the rod, whereby the explosive can be exploded as the rod is axially shifted by pushing the finger-push portion of the outer shell. This requires that the explosive cylinder must be of a special construction such that it is fitted with a rigid rod. In addition, such construction involves complex explosive setting. These facts naturally mean higher cost of manufacture.

This invention is directed to solving these problems with the prior art, and accordingly it is an object of the invention to provide a push-type cracker which uses a conventional type of explosive unit consisting of a powder explosive and a trigger string but yet can be accurately exploded by finger-pushing the explosive unit from a direction perpendicular to the direction in which the trigger string extends (i.e., by depressing the trigger string perpendicularly to longitudinal direction of the trigger string), and which can be manufactured at a lower cost.

In order to accomplish the foregoing object, the push-type cracker of the invention comprises a synthetic resin-made cracker body 1 having a cylindrical front portion 2, a string-setting rear portion 3, and a connecting wall portion 4 and a finger-push recessed portion 5 provided between the cylindrical front portion 2 and the string-setting rear portion 3, the recessed portion 5 being cut deep inward from the peripheral surface of the cracker body, a string passage hole 8 bored in a partition wall portion 6 which serves as the forward end face of the recessed portion 5, the string passage hole 8 communicating to an explosive loading chamber 7 in the cylindrical front portion, and an explosive release cover 9 for closing a front end opening 2*a* of the cylindrical front portion 2.

In the cracker body 1 is set an explosive unit 10 which comprises a powder explosive 11 housed in the explosive loading chamber 7 of the cracker body 1 and supported in position by partition wall portion 6, and a trigger string 12 for causing the powder explosive 11 to be exploded through sliding friction thereof, the trigger string 12 being passed through the string passage hole 8 and fastened to the string setting rear portion 3 in such a manner that it extends taut overlying the recessed portion 5 of the cracker body. With the foregoing arrangement, the powder explosive 11 can be exploded by depressing with thumb the trigger string 12 overlying the recessed portion 5 of the cracker body 1 from a direction perpendicular to the longitudinal direction of the string when the cracker body 1 is hand-gripped.

The cracker body 1 in which the explosive unit 10 is set may be put for sale as such, that is, in its bare state.

In order to enhance the commercial design value and handling safety of the cracker, a forcibly breakable seal (not shown) may be applied to the exterior of the cracker body 1 for covering the recessed portion 5, or a paper-made decorative cap 21 having a finger-push portion 20 positionally corresponding to the recessed portion 5 may be fixedly fitted on the exterior of the cracker body 1. In the latter case, the powder explosive 11 can be exploded by inwardly pushing the finger-push portion 20 of the decorative cap 21 thereby to depress the trigger string 12 overlying the recessed portion 5 from the direction perpendicular to the longitudinal direction of the string.

In the cylindrical front portion 2 of the cracker body 1 may be set the powder explosive 11 only. Optionally, in order to enhance the attractiveness of the cracker as such, the interior of the cylindrical front portion 2 may be partitioned by a pressure plate 13 into an explosive loading chamber 7 and an interior space 14, the interior space 14 being utilized for housing a set of dischargeable items 15 to be sent off in the air, such as tiny rolls of tape. The string-setting rear portion 3 of the cracker body 1 may be such that the rear end of the trigger string 12 is fixedly secured in place by means of adhesive or the like. Alternatively, in order to insure efficient string setting operation and accurate string fastening, the arrangment for string setting is preferably such that the trigger string 12 is received in a string fixing groove 23 for being fixedly secured therein.

The push-type cracker according to the invention uses a conventional type of explosive unit 10 consisting of a powder explosive 11 and a trigger string 12, and yet provides the advantage that the powder explosive 11 can be accurately exploded by a mere thumb push from a direction perpendicular to the trigger string 12 (i.e., depressing the trigger string 12 perpendicularly to the longitudinal direction thereof). Therefore, the invention provides for considerable reduction in the cost of manufacture as compared with the known push-type cracker.

Figure 1:
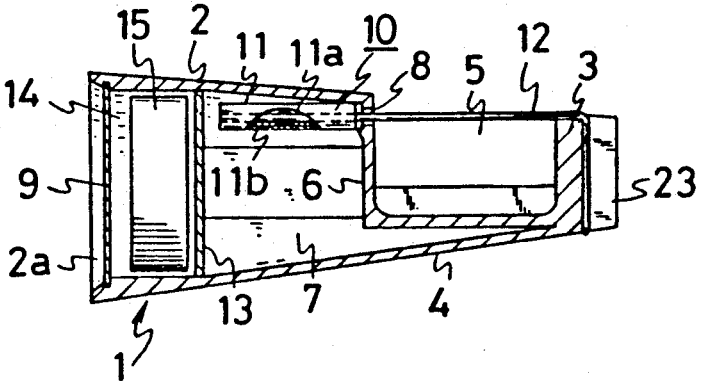
FIG. 1 is a central longitudinal sectional view showing a push-type cracker representing a first embodiment of the invention.

1 . . . cracker body; 2 . . . cylindrical front portion; 2a . . . front end opening; 3 . . . string setting rear portion; 4 . . . connecting wall portion; 5 . . . recessed portion; 6 . . . partition wall portion; 7 . . . explosive loading chamber; 8 . . . string passage hole; 9 . . . explosive release cover; 10 . . . explosive unit; 11 . . . powder explosive; 12 . . . trigger string; 13 . . . pressure plate; 14 . . . inner space; 15 . . . dischargeable items such as tiny tape rolls; 20 . . . finger-push portion; 20a . . . finger-push broken line; 21 . . . decorative cap; 23 . . . string fixing groove; 24 . . . projecting pin at rear end; 25 . . . string fixing cap; 26 . . . small hole.

DETAILED DESCRIPTION OF THE PREFERRED EMBODIMENTS

A first embodiment of the invention will now be described in detail with reference to FIGS. 1 to 3 of the accompanying drawings.

This embodiment represents a push-type cracker in a commercial product form in which a cracker body 1 is exposed in its bare state. The cracker body 1, synthetic resin made and cone-shaped, comprises a cylindrical front portion 2, a string setting rear portion 3, and a connecting wall portion 4 and a finger-push recessed portion 5 formed between the cylindrical front portion 2 and the string-setting rear portion 3, the recessed portion 5 being cut deep inward from peripheral sides of the cracker body. A partition wall portion 6 which serves as the front end face of the recessed portion 5 is formed with a string passage hole 8 which is in communication with an explosive loading chamber 7 provided in the cylinder interior. A front end opening 2a of the cylindrical front portion 2 is closed with an explosive release cover 9.

An explosive unit 10 is set in the cracker body 1. The explosive unit 10 comprises a powder explosive 11 housed in the explosive loading chamber 7 of the cracker body 1 and supported in position by the partition wall portion 6, and a trigger string 12 for triggering the powder explosive 11 to be exploded through sliding friction, the trigger string 12 being passed through the string passage hole 8 and fastened to the string-setting rear portion 3 in such a way that it extends taut overlying the recessed portion 5 of the cracker body.

Figure 4:
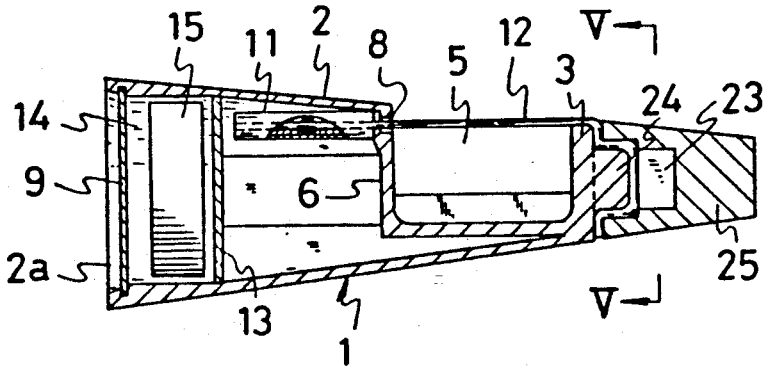
FIG. 4 is a central longitudinal sectional view showing another embodiment having an improved trigger-string setting arrangement.
Figure 5:
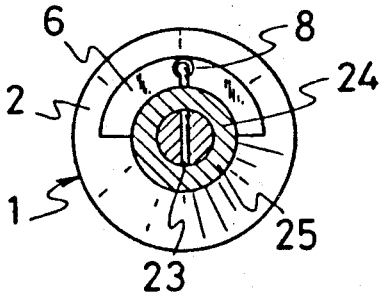
FIG. 5 is a cross section taken along line V—V in FIG. 4.
Figure 6:
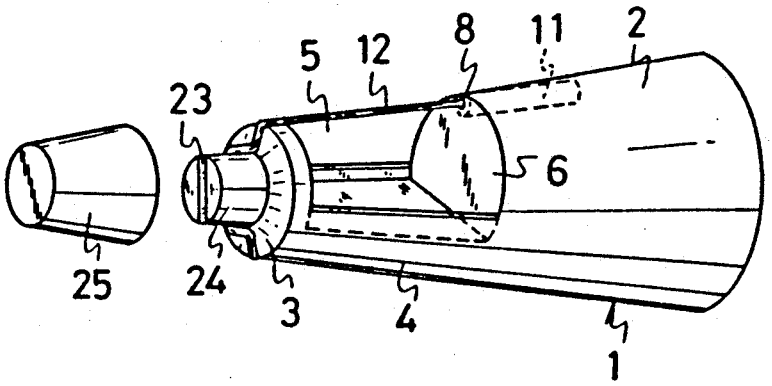
FIG. 6 is a perspective view showing the cracker body in FIG. 4, with the cap shown as separated therefrom.

The string-setting rear portion 3 of the cracker body 1 may be such that the rear end of the trigger string 12 is fixedly secured in place by adhesive or the like. In the present embodiment, however, in order to insure efficient string setting and accurate string fastening, there is employed an arrangement such that the trigger string 12 is successively fitted in a plurality of, for example, three string-fixing grooves 23 in a staggered fashion for being fixed in position as shown in FIGS. 1 and 2, or such that the trigger string 12 is fitted in a string fixing groove 23 formed in a projecting pin 24 at the rear end of the body, as shown in FIG. 6, the string being then fixed in position by fitting a string fixing cap 25 on the projecting pin 24 as shown in FIGS. 4 and 5.

The powder explosive 11 is a paper-wrapped explosive comprising an explosive powder material 11a which produces sound when slide-contacted by the trigger string 12, the powder being wrapped in a piece of wrap paper 11b. The powder explosive 11 is adapted to be exploded by pushing the trigger string 12 overlying the recessed portion 5 from a direction perpendicular to the longitudinal direction of the string 12 while the cracker body is hand-gripped. The shape of the cracker body 1 is not necessarily limited to such conical shape as shown. The body may be of an elongate cylinder shape or otherwise.

Figure 7:
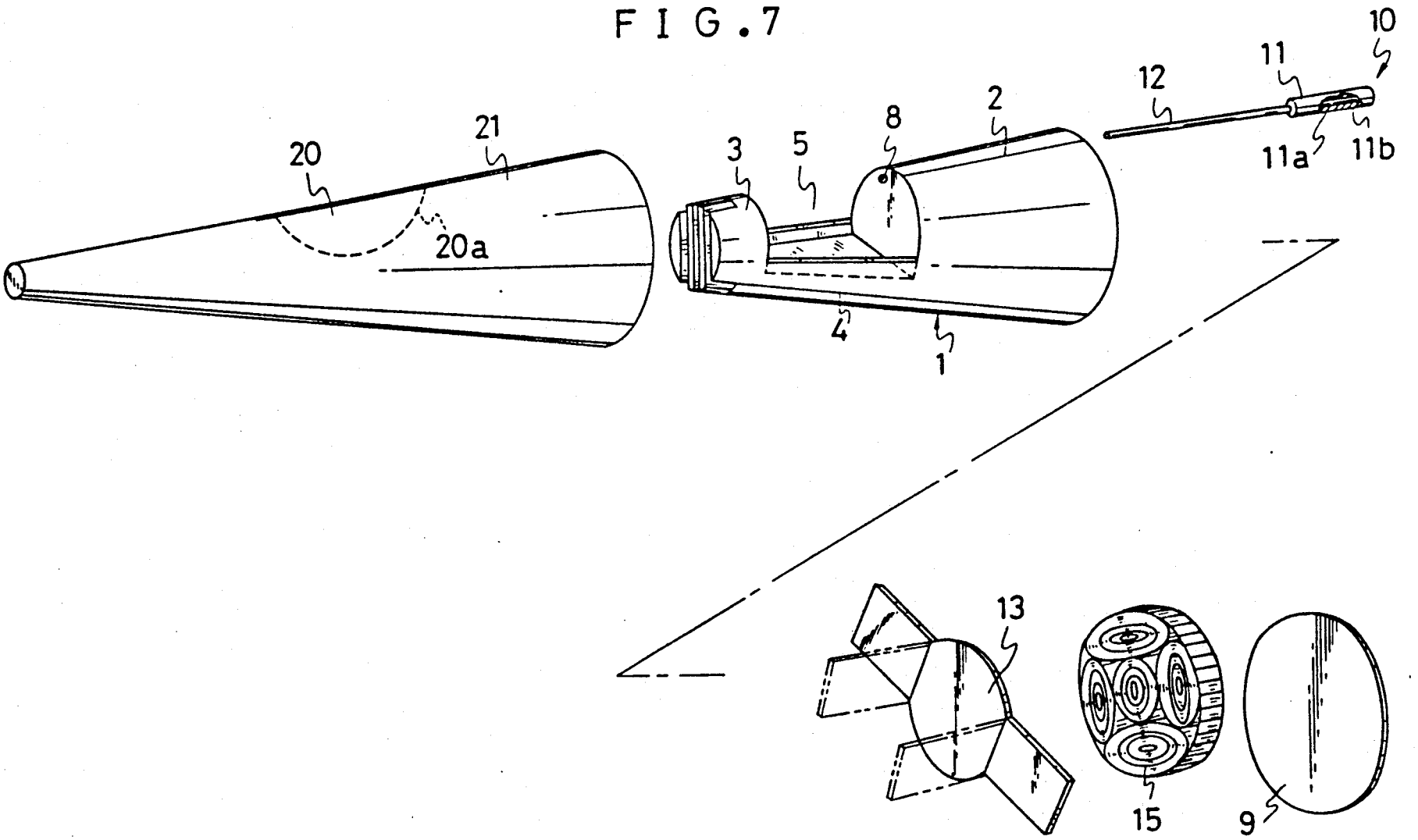
FIG. 7 is an exploded perspective view of a push-type cracker equipped with a decorative cap which represents another embodiment.
Figure 8:
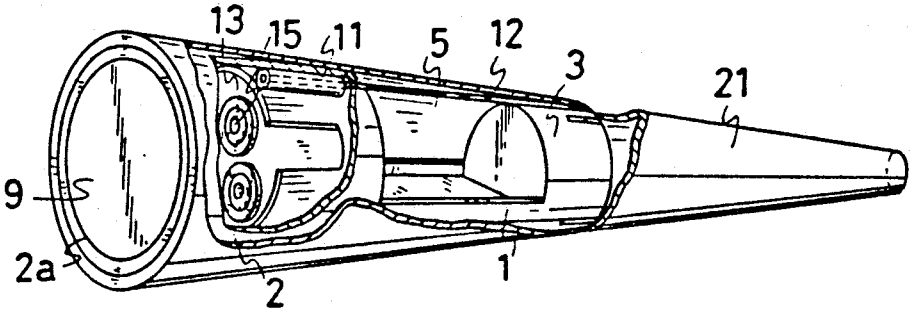
FIG. 8 is a partially cutaway perspective view of the same cracker shown in assembled condition.
Figure 9:
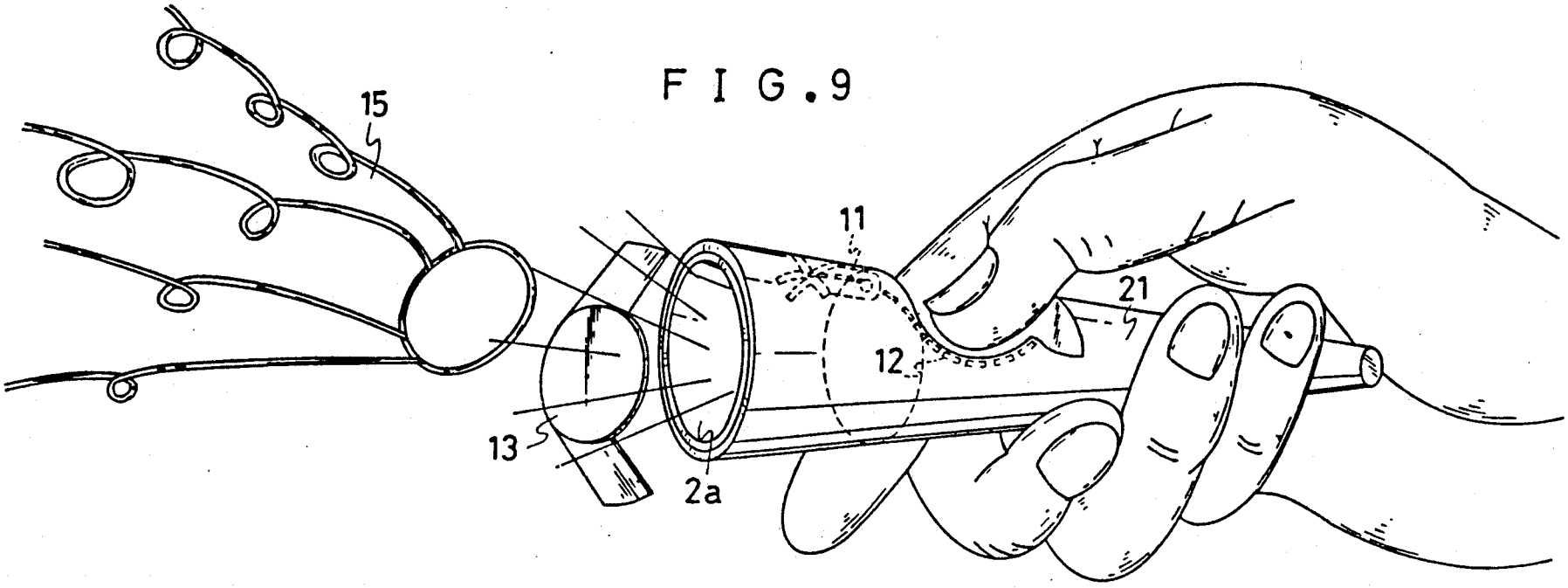
FIG. 9 is a perspective view of the cracker as exploded by thumb-push triggering while the cracker body is hand-gripped.

FIGS. 7 to 9 illustrate another form of push-type cracker which has a paper-made decorative cap 21. This decorative cap 21 is constructed of a paper-made conical tube having a larger length than the cracker body 1, the cap 21 being fitted over the body 1 for adhesion contact therewith. A finger-push portion 20 positionally corresponding to the recessed portion 5 is formed on the outer periphery of the cap 21 in a region defined by a finger-push broken line 20, as shown in FIG. 7.

In the case of this embodiment, the finger-push portion 20 of the decorative cap 21 is pushed with a finger (thumb) inward so that the trigger string 12 overlying the recessed portion is depressed from a direction perpendicular to the longitudinal direction of the string as shown in FIG. 9, whereby the powder explosive 11 is exploded through sliding friction of the string, dischargeable items 15 such as tiny rolled tapes being sent off in the air through the cover-released front opening 2a of the cracker body as shown in FIG. 9.

Figure 10:
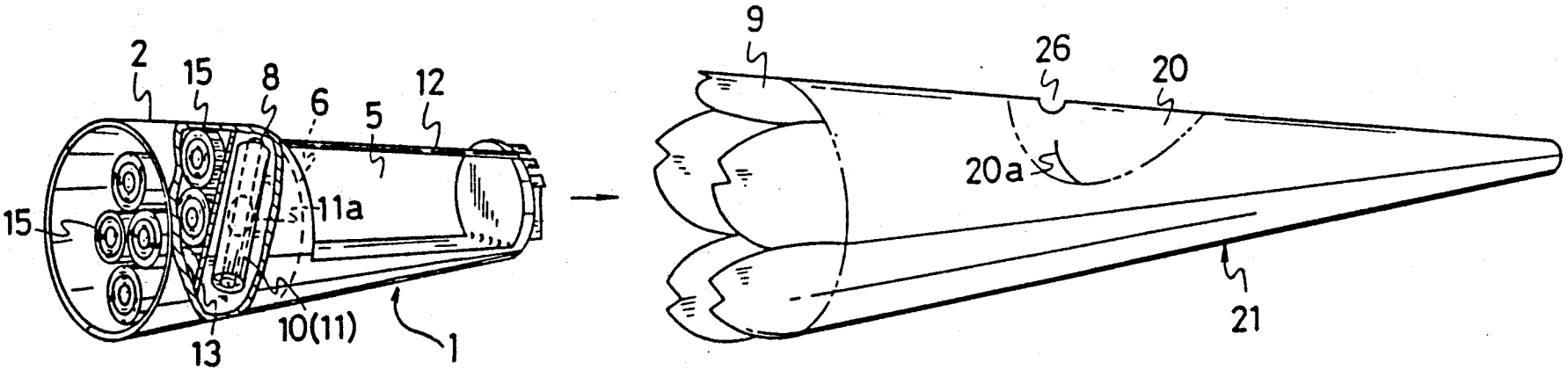
FIGS. 10 through 13 show another embodiment in which the decorative cap 21 is formed in its finger-push portion 20 with a small hole 26, FIGS. 10 and 11 being perspective views, FIG. 12 being a fragmentary sectional view, and FIG. 13 being a plan view.
Figure 11:
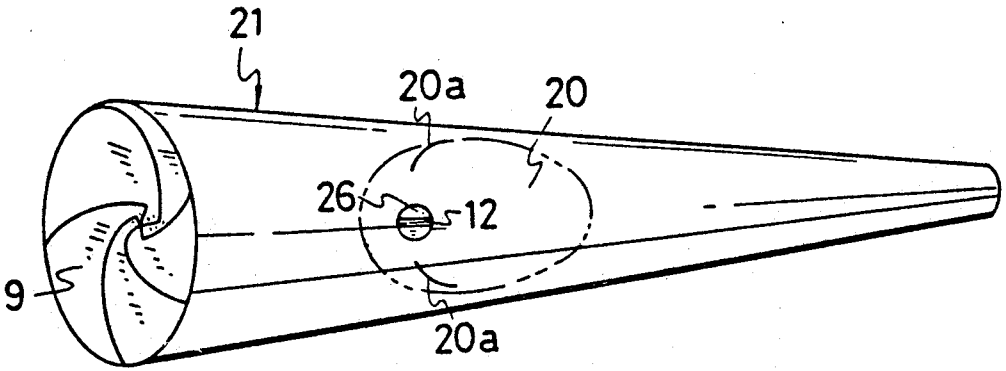
Figure 12:
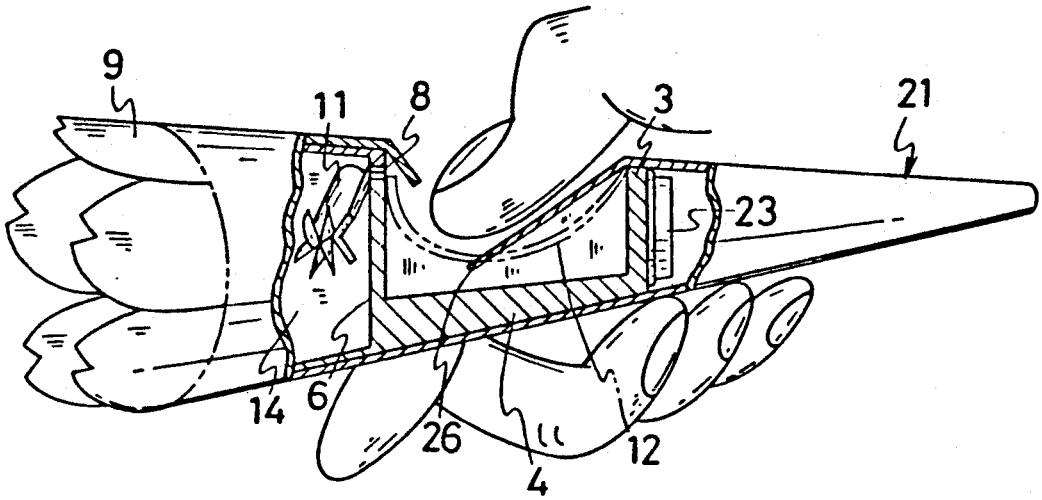
Figure 13:
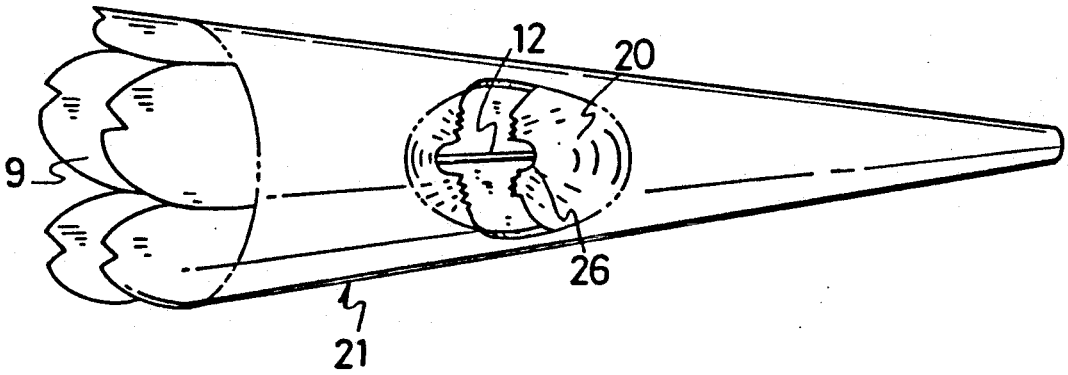

Where, as shown in FIGS. 10 and 11, a small hole 26 is formed in the finger-push portion 20 of the decorative cap 21 on an extension of the finger-push broken line 20a and at a point corresponding positionally to the trigger string 12, the trigger string 12 is caught by the small hole 26, as shown in FIGS. 12 and 13, when the finger-push portion 20 is broken, so that the trigger string 12 is accurately pulled for triggering.

Figure 2:
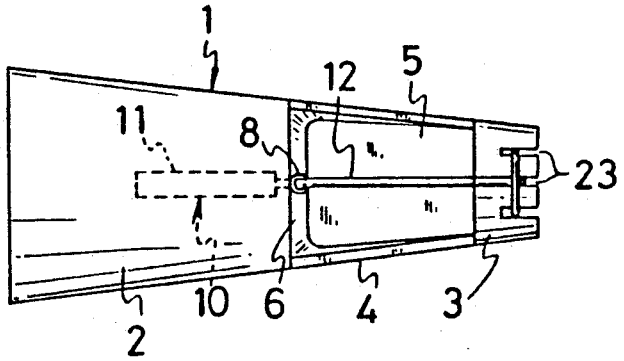
FIG. 2 is a plan view of the cracker.
Figure 3:
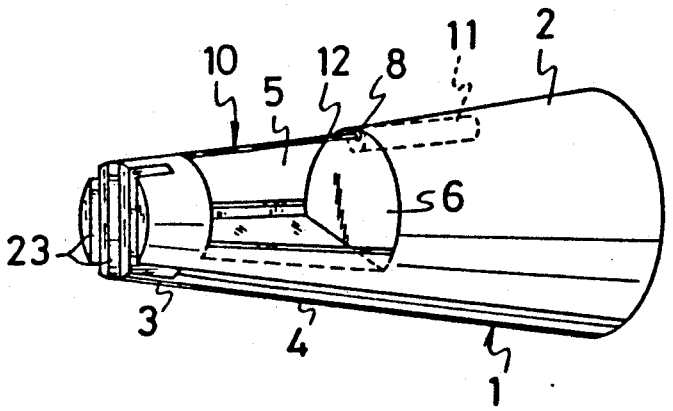
FIG. 3 is a perspective view of the cracker.

In these other embodiments, the construction of the cracker body 1 and explosive unit 10 setting is same as that of the first embodiment shown in FIGS. 1 to 3 and, therefore, description as to details thereof has been omitted, like parts being designated by like reference numerals.

What is claimed is:

1. A push-type cracker comprising a cracker body having a cylindrical front portion, a string setting rear portion, and a connecting wall portion and a finger-push recessed portion provided between the cylindrical front portion and the string setting rear portion, the recessed portion being cut deep inward from the peripheral surface of the cracker body, and a string passage hole bored in a partition wall portion which serves as the forward end face of the recessed portion, the string passage hole communicating to an explosive loading chamber in the cylindrical front portion; an explosive release cover for closing a front end opening of the cylindrical front portion; and an explosive unit set in the cracker body comprising a powder explosive housed in the explosive loading chamber of the cracker body and supported in position by the partition wall portion, and a trigger string for causing the powder explosive to be exploded through sliding friction thereof, the trigger string being passed through the string passage hole and fastened to the string setting rear portion in such a manner that it extends taut overlying the recessed portion of the cracker body, whereby the powder explosive can be exploded when the trigger string overlying the recessed portion of the cracker body is finger-pushed from a direction perpendicular to the longitudinal direction of the string.

2. A push-type cracker as set forth in claim 1, further comprising a set of dischargeable items housed in an interior space defined between the explosive release cover for closing the front end opening of the cylindrical front portion and a pressure plate provided in the cylindrical front portion, the dischargeable items being adapted to be sent off in the air through the front end opening simultaneously with the release of the cover when the powder explosive is exploded, and a decorative cap having a finger-push portion formed thereon which positionally corresponds to the recessed portion of the cracker body, the decorative cap being securely fitted over the cracker body in which both the dischargeable items and the explosive unit are set in position, whereby the powder explosive is exploded by depressing the trigger string overlying the recessed portion from a direction perpendicular to the longitudinal direction of the string, the dischargeable items such as tiny paper rolls being simultaneously sent off in the air.

3. A push-type cracker as set forth in claim 1 or 2, wherein the string setting rear portion of the cracker body has a string fixing groove or grooves for receiving the trigger string to fix it in position.

4. A push-type cracker as set forth in claim 2, wherein the decorative cap has a small hole formed in its finger-push portion, on an extension of a finger-push broken line and at a point corresponding positionally to the trigger string.

* * * * *